United States Patent [19]

McDermott

[11] 4,272,325

[45] Jun. 9, 1981

[54] DOOR JAMB CONSTRUCTION FOR COKE OVENS

[75] Inventor: John F. McDermott, Monroeville, Pa.

[73] Assignee: United States Steel Corporation, Pittsburgh, Pa.

[21] Appl. No.: 163,742

[22] Filed: Jun. 27, 1980

Related U.S. Application Data

[63] Continuation-in-part of Ser. No. 94,616, Nov. 15, 1979, abandoned.

[51] Int. Cl.[3] ..... C10B 25/06

[52] U.S. Cl. ..... 202/248; 110/173 R

[58] Field of Search ..... 202/242, 248, 268, 269, 202/270; 110/173 R

[56] References Cited

U.S. PATENT DOCUMENTS

| | | | |
|---|---|---|---|
| Re. 20,515 | 9/1937 | Van Ackeren | 202/248 |
| 2,778,785 | 1/1957 | Otto | 202/248 |
| 3,175,961 | 3/1965 | Olsen | 202/268 X |
| 3,190,818 | 6/1965 | Otto | 202/268 |
| 3,247,079 | 4/1966 | Wethly | 202/268 X |
| 4,131,421 | 12/1978 | Abendroth | 110/173 R X |
| 4,200,499 | 4/1980 | Gerding | 202/248 |

FOREIGN PATENT DOCUMENTS

| | | | |
|---|---|---|---|
| 2755020 | 6/1979 | Fed. Rep. of Germany | 202/248 |

*Primary Examiner*—Tim R. Miles
*Assistant Examiner*—Roger F. Phillips
*Attorney, Agent, or Firm*—William F. Riesmeyer

[57] ABSTRACT

A door jamb construction for a coke oven in which the vertical legs of the jamb are essentially rigid in a direction parallel with the oven wall but flexible in a direction normal to the wall. The buckstays of the oven carry spring means which force the flexible legs into contact with the oven wall.

10 Claims, 4 Drawing Figures

DOOR JAMB CONSTRUCTION FOR COKE OVENS

This application is a Continuation-in-Part of prior copending application Ser. No. 094,616 filed Nov. 15, 1979, now abandoned.

This invention relates to an improved door jamb construction for coke ovens.

Leakage of gases from coke ovens is recognized as a serious problem. One of the paths through which gases may leak is through separations between the door jambs and the brickwork of the oven wall. When the oven is heated, the vertical legs of the jambs tend to distort in directions both parallel with the plane of the wall and normal thereto. Parallel distortion produces an "hourglass" effect, that is, the vertical legs tend to bow inwardly toward each other. Distortion in a direction normal to the wall pulls both the top and bottom extremities of the legs away from the wall. Either form of distortion may create separations, which in time may become permanent, particularly if deposits of tar or the like form between the jamb and the firewall. The distortion problem is most acute in relatively high jambs, such as the six meter jambs used in some ovens of recent construction.

The conventional way of minimizing distortion of jambs has been to make the vertical legs as rigid as possible in directions both parallel with the oven wall and normal thereto. In one well-known form of jamb each vertical leg includes a flange which lies between the adjacent buckstay and the wall, and a rib which projects outwardly away from the wall. The flange and rib enhance rigidity in the two directions. Reference can be made to Tucker U.S. Pat. No. 2,812,292 or McClure U.S. Pat. No. 2,965,550 for exemplary showings. It is known also to mount springs on the buckstays to exert force on the jambs to provide additional stiffening of the jamb legs in a direction normal to the wall, as shown for example in British Pat. No. 935,238.

Use of a flange to stiffen the vertical legs in the parallel direction appears to be effective in overcoming hourglassing, but my observation is that stiffening the legs is ineffective for preventing distortion in a direction normal to the wall. Because of thermal gradients, vertical legs which are extremely rigid still pull away from the wall and create separations. According to my invention, I make the vertical legs rigid in a direction parallel with the wall, but I intentionally make them somewhat flexible in the direction normal to the wall. I then use spring pressed plungers mounted on the buckstays to push the vertical legs into contact with the wall as the legs distort or flex.

An object of my invention is to provide an improved coke oven jamb construction which is more effective in preventing separation between the jamb and the brickwork of the oven wall than jambs used heretofore.

A more specific object is to provide an improved jamb construction in which the vertical legs of the jamb are essentially rigid in a direction parallel with the wall, but have controlled flexibility in a direction normal to the wall, whereby spring pressure applied to the legs effectively maintains them in contact with the wall.

Figure 1:
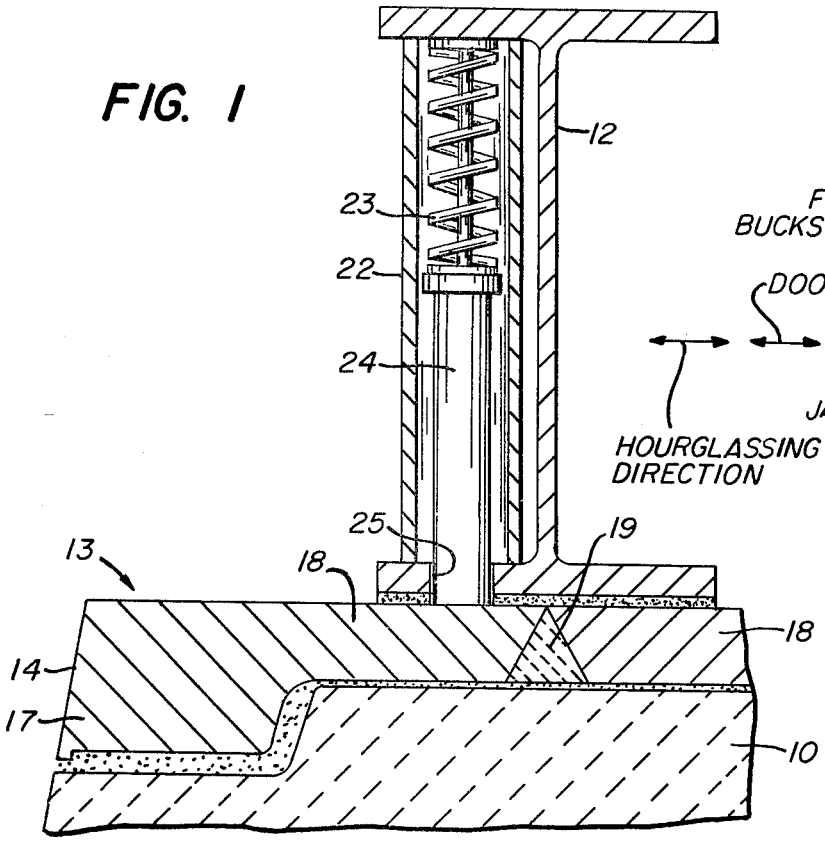
FIG. 1 is a horizontal sectional view through a coke oven wall, one buckstay, and the vertical legs of adjacent jambs constructed in accordance with my invention.

FIG. 1 shows in horizontal section coke oven parts which include a wall 10 of brickwork, a buckstay 12, and the vertical legs 13 of jambs at opposite sides of the buckstay. Each leg 13 defines one edge of a door opening 14. The oven may be conventional apart from my improved jamb construction, and hence is not shown in detail.

In accordance with my invention, the vertical leg 13 of each jamb has a core 17 substantially rectangular or rhomboidal in cross section and an integral flange 18. The core lies along the door opening 14, and the flange extends from the opposite edge of the core parallel with the wall 10. The flange lies between the buckstay 12 and the wall and terminates just short of the central vertical plane of the buckstay. An asbestos rope 19 or equivalent refractory separates the flanges of the two adjacent jambs behind the buckstay. It is to be noted that the vertical leg has no outwardly projecting rib found on the vertical legs of many jambs, such as those shown in the aforementioned patents. The only outward projections are the means (not shown) for accommodating the latching and/or door guiding mechanism, but these do not appreciably affect either the stiffness nor the temperature gradient. The flange 18 provides stiffness or rigidity in the direction parallel with the wall and thus forestalls hourglassing, while the absence of a rib permits flexibility in the direction normal to the wall.

The buckstay 12 carries a series of vertically spaced spring housings 22, only one of which is shown. Respective compression springs 23 and plungers 24 are mounted in the housings. The plungers extend through holes 25 in the inner flange of the buckstay and bear against the flange 18 of the jamb leg. As the legs distort when the oven is heated, the springs and plungers push the legs toward the wall 10 and thus maintain the legs in contact with the wall. I have found that seven uniformly spaced springs and plungers holding each jamb leg can be sufficient in a six-meter high jamb, but it is apparent the number may vary.

Figure 2:
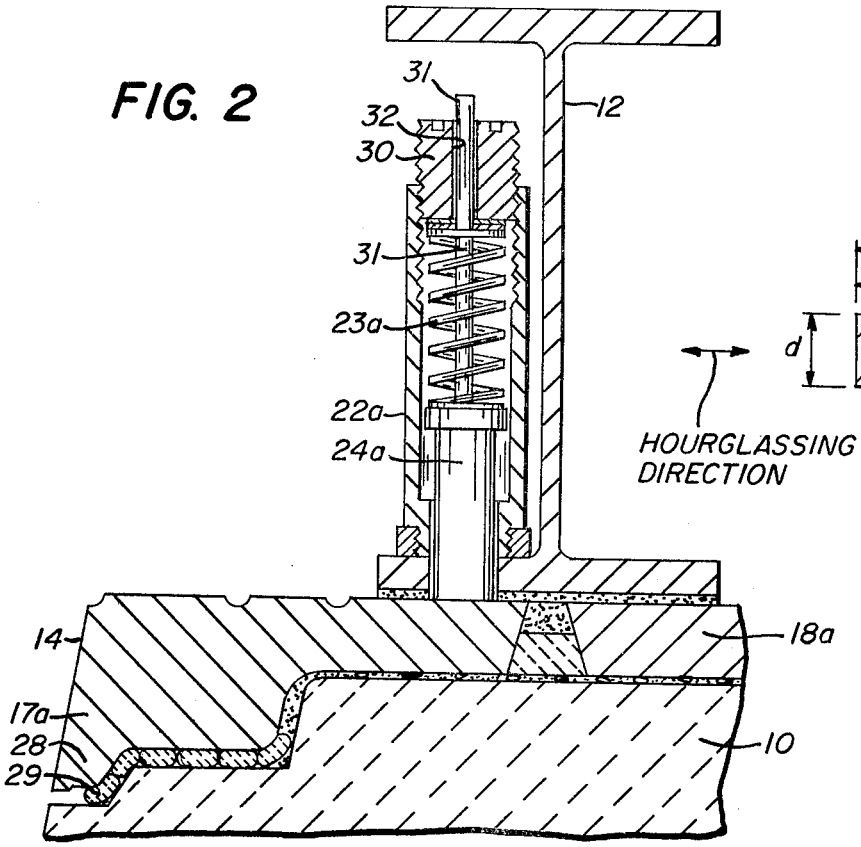
FIG. 2 is another view similar to FIG. 1, but showing a modification.

FIG. 2 shows a modification in which the core **17*a* has a small inwardly projecting rib 28 to retain packing 29. From the standpoint of providing flexibility, the presence of the rib is undesirable, but in some installations the rib is needed for other considerations. Also in the modification, the spring housing 22*a* terminates short of the outer flange of the buckstay. An adjusting screw 30 is threadedly engaged with the housing at its outer end. The plunger 24*a* carries an indicator rod 31 which projects through an axial bore 32 in the adjusting screw. The force exerted by spring 23*a* on the jamb leg can be adjusted by turning the screw 30. The distance which the rod 31** projects from the screw furnishes an indication of the force.

Figure 3:
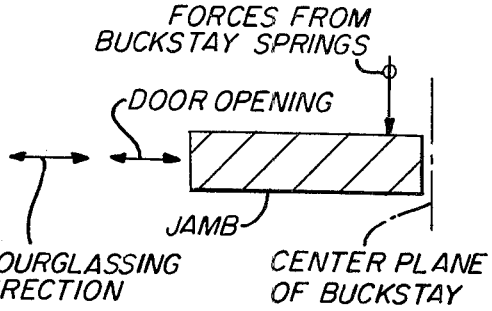
FIG. 3 is a diagrammatic horizontal sectional view of a jamb of ideal cross-sectional configuration from the standpoint of preventing distortion.

As shown in FIG. 3, from the standpoint of providing maximum rigidity in one direction and maximum flexibility in the other, the ideal vertical leg would be rectangular in cross-section. The width of the rectangle would be the maximum that could be accommodated between door opening and the center plane of the buckstay. The thickness of the rectangle, or the various thicknesses involved in any other configuration as discussed below, would be limited to what suitable structural calculations, considering jamb temperatures and the spring restraints, indicate would result in a tolerable, very small outward movement of the jamb leg from the wall. The thickness of the jamb legs in the directions normal and parallel to the oven effect their stiffness. The moment of inertia of the legs is a convenient measure of relative stiffness and for rectangles may be approximated from the equations:

$$I_n = 1/12bt^3$$

$$I_p = 1/12tb^3$$

$$I_t = (\tfrac{1}{3}bt^3)(1-0.63t/b)$$

Where $I_n$ is the moment of inertia in a direction normal to the long sides of the rectangle i.e. about a plane parallel to said long sides, b is the length of the long side; and t is the length of the short side of the rectangle. $I_p$ is the moment of inertia in a direction parallel to the long sides of the rectangle i.e. about a plane parallel to the short sides thereof. $I_t$ is the torsional or polar moment of inertia about a vertical axis through the center point of the rectangle. For other more complex shapes, the moments of inertia may be calculated according to well known principles as disclosed for example in STRENGTH OF MATERIALS and THEORY OF ELASTICITY by S. Timoshenko.

I have found that for a six meter high battery the moments of inertia for the vertical legs of the door jamb should be:

$I_n = 141$ in.$^2$ or between about 100–200 in.$^4$ $I_p = 1310$ in.$^4$ or between about 300–3000 in.$^4$ $I_t = 248$ in.$^4$ or between about 100–600 in.$^4$ Thus, the jamb is relatively flexible in the direction normal to the oven wall so as to permit the spring means to minimize the gap formed between the jamb legs and the oven wall due to thermal distortion. The jamb is also relatively stiff in the direction parallel to the oven wall thus minimizing any tendency for hourglassing. Finally, the jamb has a torsional moment of inertia sufficient to limit outward bulging due to transfer of normal forces from the buckstay to the oven wall. Thus, the jamb has properties enabling maintenance of geometry substantially the same as its original shape when the oven is heated so as to prevent gaps between the jamb and the refractory oven wall and also between the metal door seal and the jamb.

For purposes herein all references in the specification and claims to moments of inertia are in units of in.$^4$. I have also found that the desired moments of inertia tend to be in direct proportion to the square of the battery height defined as the interior vertical dimension of the oven chamber.

Figure 4:
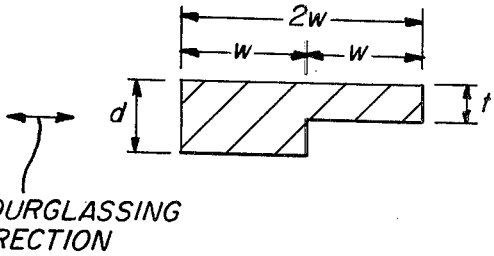
FIG. 4 is a diagrammatic horizontal sectional view of a practical embodiment of a jamb leg in which distortion is minimized.

Since a vertical leg of rectangular cross section would not fit with other parts of most ovens, I form the leg with a rectangular or rhomboidal core and a flange, as shown in FIGS. 1, 2 and 4 and as already described. FIG. 4 illustrates diagrammatically the preferred dimensional relation of the leg. The core and flange typically have approximately equal widths w. Also, the thickness t of the flange is typically approximately half the thickness d of the core. Compared with the ideal leg of rectangular cross section of equal cross-sectional area, the leg shown in FIG. 4 with equal widths for the core and flange and with t equal to d/2 has minimum stiffness in the hourglassing direction parallel with the wall of about 0.9 times the ideal, which is highly efficient, and maximum stiffness in the other direction of about 1.6 times the ideal, which can be controlled by a suitable spring system. If the core and flange have equal widths and t is very small compared with d, the stiffness in the hourglassing direction may approach only 0.25 times the ideal, and in the other direction 4 times the ideal. Other possible configurations may depart even further from the ideal. Although the core and flange dimension ratios discussed above as being preferred have resulted in suitable designs for actual construction, other ratios employing the principles discussed above will result in core and flange designs within the scope of my invention.

From the foregoing description, it is seen that my invention affords a jamb of simple construction which effectively prevents separation between the jamb and brickwork of a coke oven wall. Contrary to past views, I find that stiffness or regidity should be confined to the direction parallel with the oven wall, and that flexibility in the other direction is needed so that a spring system from the buckstays can force the jamb against the wall continuously over the entire life of a coke oven battery (and not just during a battery start-up). This will minimize the accumulation of foreign materials between the jamb and the wall that are the cause of objectionable fires, etc.

The principle of my invention applies to any end closure system in which buckstay-mounted springs even indirectly restrain the jamb, as when the buckstay-mounted springs bear against a metal firewall which in turn is connected to the jamb.

I claim:

1. In a jamb having parallel horizontal and vertical legs for bounding an opening in a coke oven refractory wall and forming a frame against which a metal door seal may be pressed closing said opening, said jamb being adapted for use with spring means mounted on a buckstay for forcing the vertical legs thereof toward said oven wall to overcome the effect of thermal distortion on said jamb, the improvement in which said jamb comprises:

vertical legs having a moment of inertia $I_n$ in in.$^4$ in a direction normal to said oven wall as measured about a plane parallel thereto of between $h^2/550$ and $h^2/275$ where h is the height of said oven in inches, so that said vertical legs are relatively flexible in said normal direction so as to permit said spring means to minimize the gap formed between said legs and the oven wall due to thermal distortion, said vertical legs also having a moment of inertia $I_p$ in a direction parallel to said oven wall as measured about a plane normal thereto between 3 and 15 times $I_n$ so as to be relatively stiff in said parallel direction thus minimizing any tendency for hourglassing, said vertical legs having a torsional or polar moment of inertia $I_t$ as measured about the longitudinal axis thereof between 1 and 3 times $I_n$ so as to limit outward bulging of the jamb due to transfer of normal forces from said buckstay to said oven wall, said jamb thus having properties enabling maintenance of geometry substantially the same as the original shape thereof when said oven is heated so as to prevent gaps between refractory and metal surfaces to which it mates on said oven.

2. The jamb of claim 1 wherein $I_p$ is between about 5 to 15 times $I_n$.

3. The jamb of claim 1 wherein $I_p$ is between about 8 to 12 times $I_n$.

4. The jamb of claims 1, 2 or 3 wherein $I_n$ is between about $h^2/500$ and $h^2/300$.

5. The jamb of claim 4 wherein $I_n$ is between about $h^2/450$ and $h^2/350$.

6. The jamb of claim 5 wherein $I_t$ is between about 1.5 to 2.5 times $I_n$.

7. The jamb of claim 1, wherein said legs have a core of substantially rectangular cross section adjacent the edge of said door opening and a flange extending from said core in a direction parallel to said oven wall, said core and said flange being about equal in width in said direction parallel to said oven wall, and said flange being approximately half the thickness of said core in a direction normal to said oven.

8. The jamb of claims 1, 2, 3 or 7 wherein h is between about 170 inches and 400 inches.

9. The jamb of claim 8 wherein h is between about 230 to 400 inches.

10. The jamb of claim 9 wherein h is between about 230 and 330 inches.

* * * * *